US005580178A

United States Patent [19]

Grubb

[11] Patent Number: 5,580,178

[45] Date of Patent: Dec. 3, 1996

[54] RIBBON REINKING APPARATUS

[76] Inventor: Roger E. Grubb, 1321 Virginia Ave., Dunbar, W. Va. 25064

[21] Appl. No.: 389,401

[22] Filed: Feb. 16, 1995

[51] Int. Cl.[6] ..... B41J 31/14

[52] U.S. Cl. ..... 400/197; 400/200

[58] Field of Search ..... 400/197, 200, 400/201, 202, 202.1–202.4

[56] References Cited

U.S. PATENT DOCUMENTS

| | | | |
|---|---|---|---|
| 3,067,056 | 12/1962 | Remer | 101/364 |
| 3,242,856 | 3/1966 | Gates | 101/364 |
| 5,005,997 | 4/1991 | Chung | 400/197 |
| 5,048,986 | 9/1991 | Czesnik et al. | 400/197 |
| 5,071,271 | 12/1991 | Chang et al. | 400/202.4 |
| 5,267,801 | 12/1993 | Huang | 400/197 |

FOREIGN PATENT DOCUMENTS

| | | | |
|---|---|---|---|
| 3435082 | 4/1986 | Germany | 400/197 |

*Primary Examiner*—Edgar S. Burr
*Assistant Examiner*—Anthony H. Nguyen

[57] ABSTRACT

Apparatus for reinking ribbons that can accept ribbon cartridges of different kinds and shapes, and can be modified easily to reink reel to reel type ribbons. The apparatus includes a soft surfaced clamp for contacting cartridges of varying external shape. A tapered varying width drive head can engage within drive connection apertures of different diameters on different cartridges. The location of the inker is varied depending upon whether there is a right hand or left hand drive for the ribbon.

7 Claims, 3 Drawing Sheets

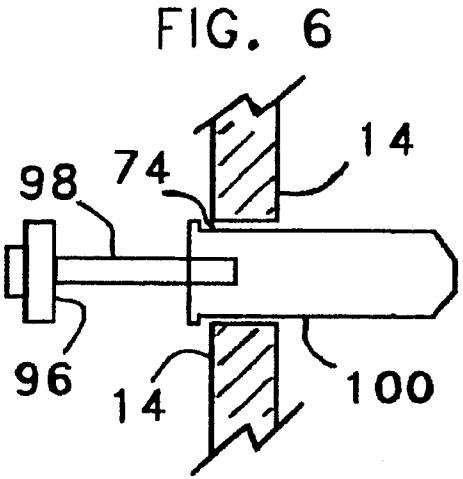
FIG. 6
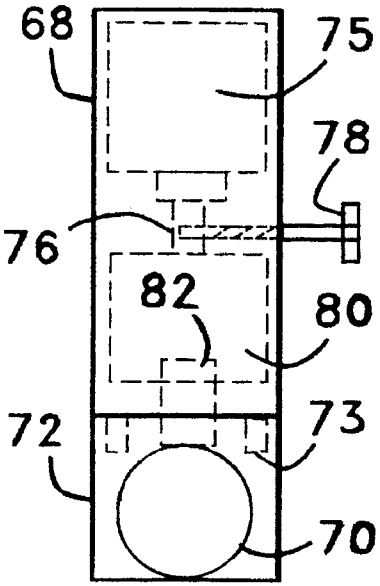
FIG. 5
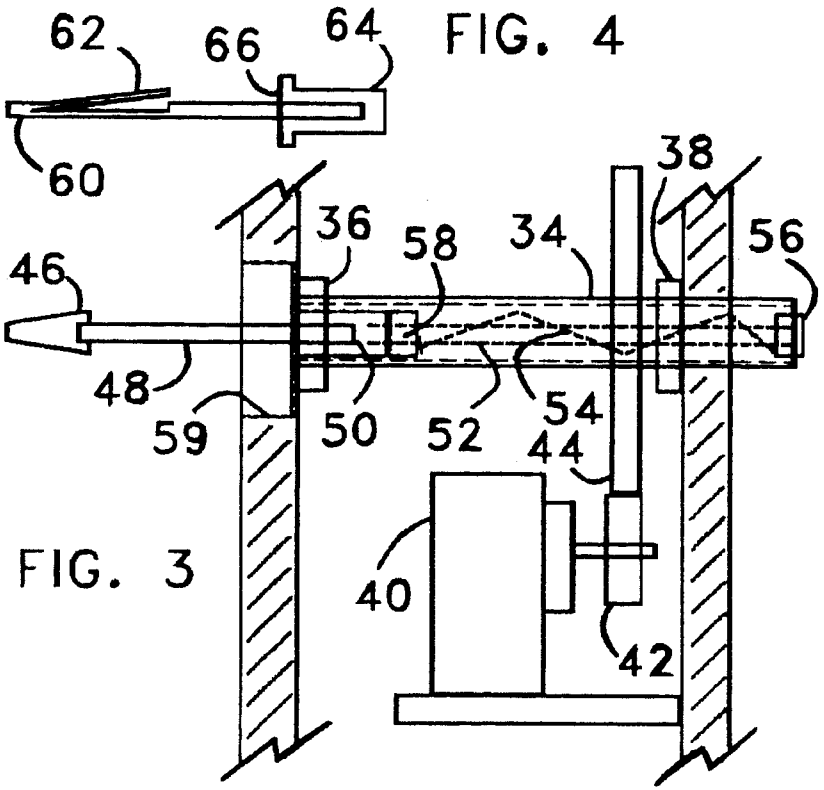
FIG. 4
FIG. 3

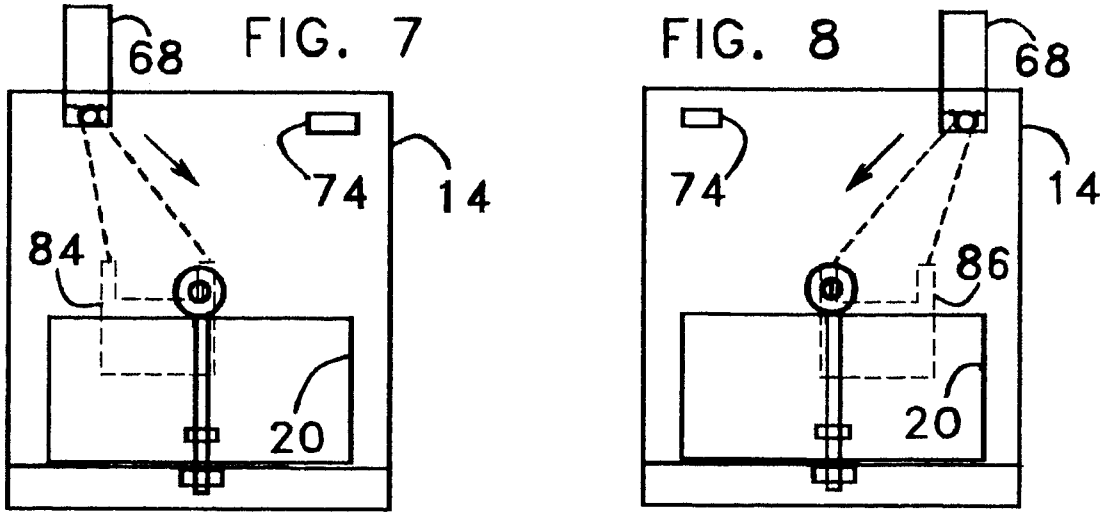
FIG. 7
FIG. 8
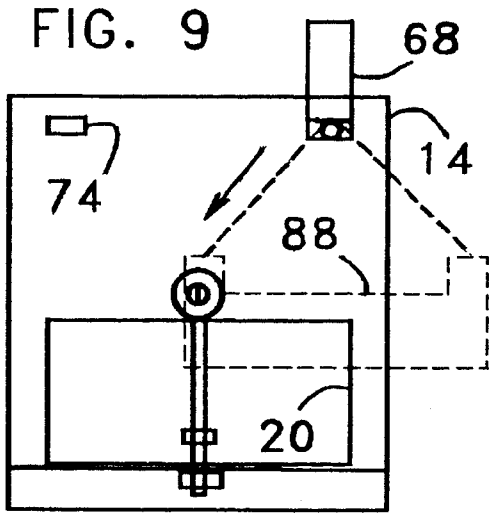
FIG. 9
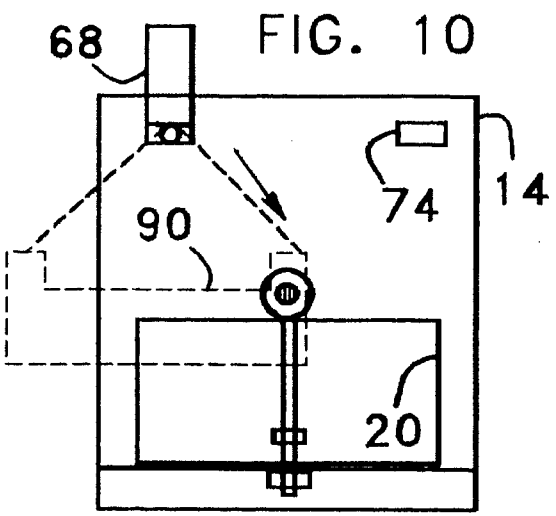
FIG. 10
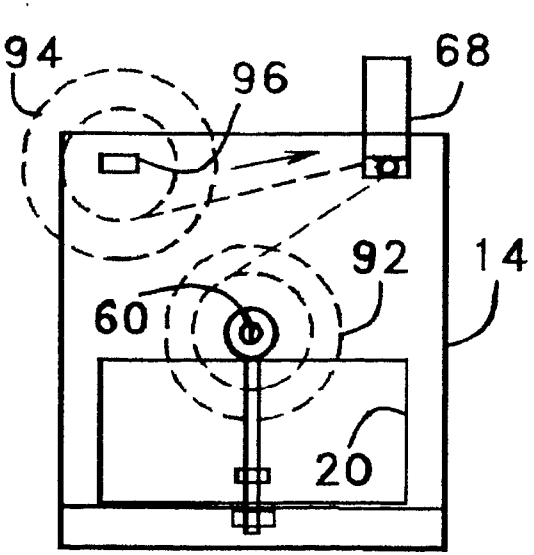
FIG. 11

RIBBON REINKING APPARATUS

BACKGROUND OF THE INVENTION

1. Field of the Invention

This invention relates to apparatus for reinking ribbons in computer printer ribbon cartridges and the like without removing the ribbon from the cartridge. The apparatus can reink ribbon cartridges of various sizes and shapes, and also has provision to reink reel to reel type ribbons.

2. Prior Art

There have been various proposals to extend the life of ribbons used in computer printers, word processors, and typewriters by reinking the ribbons.

Some such prior art proposals put reinking means inside the ribbon cartridge.

Other proposals such as U.S. Pat. No. 4,126,715 to Schiffmacher et al, and U.S. Pat. No. 5,035,522 to Wright, have withdrawn a ribbon from a cartridge and passed it to an inking station and then back to the cartridge.

Prior art devices for reinking have been limited in the size and type of cartridge that the apparatus could process. However, ribbon cartridges now come in many different sizes and shapes. Some cartridges have right hand drive connections, and other are left hand drive. The cartridges of different make and use may have projecting drive connections in different locations. Also, ribbons may be of the reel to reel type.

SUMMARY OF THE INVENTION

A primary object of my invention is to provide a novel ribbon reinking apparatus that can reink many different size and shape ribbon cartridges and reel to reel type ribbons with minor adjustment to the apparatus.

Briefly, the multiple use ribbon reinking apparatus of the invention includes a soft surfaced cartridge clamp for contacting and holding cartridges of varying external shape without damaging the cartridge including any projections on the cartridge. Small and large cartridges and left hand and right hand drive cartridges may be positioned in the clamp. The apparatus also includes a tapered varying width drive head which may be inserted into drive connection apertures on the cartridges, which apertures may vary in diameter depending upon the make and type of cartridge. A cylindrical drive head may be substituted when reinking a reel to reel type ribbon.

The versatility of the apparatus is further increased by provision to easily reposition the inker to switch between right hand drives and left hand drives.

BRIEF DESCRIPTION OF THE DRAWINGS

FIG. 3 is an elevational view on an enlarged scale of the cartridge drive head apparatus of FIG. 1.

FIG. 4 is a detail view of the drive head used in FIG. 3.

FIG. 5 is an elevational view on an enlarged scale of the inker of FIG. 1.

FIG. 6 is a view partly in section of a drive head for use with reel to reel type ribbons.

FIG. 7 is a somewhat schematic elevational view showing the position of a small, right hand drive cartridge during reinking.

FIG. 8 is a view similar to FIG. 7, but showing a small, left hand drive cartridge being reinked.

FIG. 9 is a view similar to FIG. 8, but showing a large, left hand drive cartridge being reinked.

FIG. 10 is a view similar to FIG. 7, but showing a large right hand drive cartridge during reinking.

FIG. 11 is a view similar to FIG. 7 showing a reel to reel type ribbon during reinking.

DETAILED DESCRIPTION OF THE INVENTION

Figure 1:
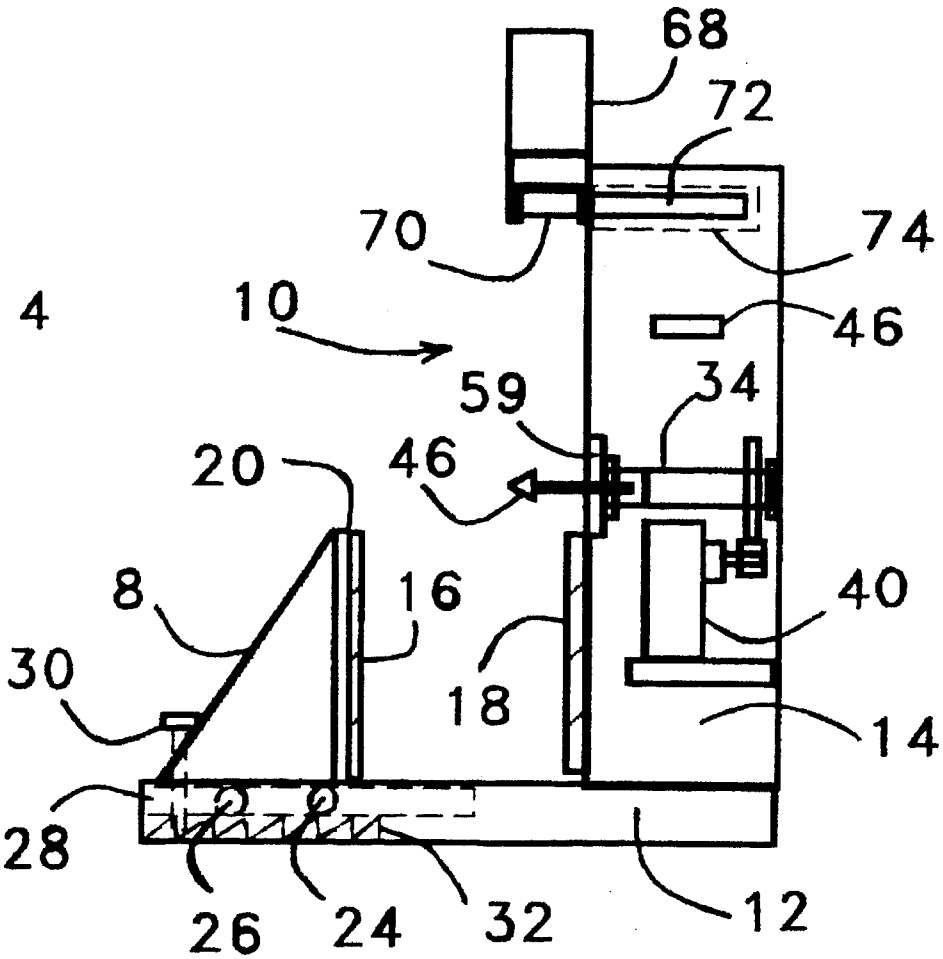
FIG. 1 is an elevational view of a presently preferred embodiment of the invention.
Figure 2:
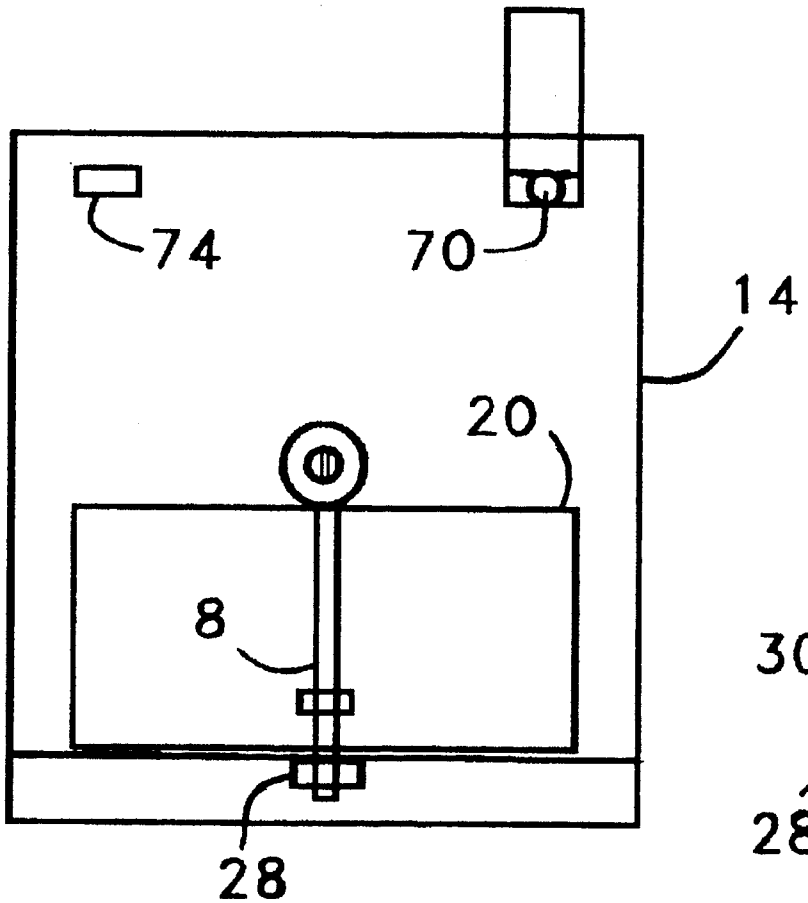
FIG. 2 is a left side view of the embodiment of FIG. 1.

Referring to the drawings, and more particularly to FIG. 1; reference numeral 10 generally designates a novel ribbon reinking apparatus in accordance with a presently preferred embodiment of the invention. The apparatus includes a support frame made of a horizontal base 12 and a vertical support housing 14.

A pair of soft plate members 16 and 18 form a clamp for holding a ribbon cartridge between them. Plate 16 is movable on the base 12 towards and away from plate 18 which is fixed to support housing 14. Support plates 16 and 18 are made of a soft resilient material such as sponge rubber which will deform to accommodate cartridges of different size and shape. Many cartridges have protruding parts such as guides and guide pins that stick out from the cartridge. In such instances the resiliency of the support plates 16 and 18 is necessary for the cartridge to be clamped in proper alignment and without damage. The movable support plate 16 is attached to a backing plate 20 that has a brace 8. Pins 24 and 26 on the bottom of brace 8 slide within a slot 28 in base 12. When support plate 16 is in proper position, a locking pin 30 is pushed down into one of a series of saw-toothed locking recesses 32 in base 12.

FIG. 3 illustrates the cartridge drive apparatus which includes a rotatable drive tube 34 supported by a pair of front and rear drive bearings 36, 38. A reversible motor 40 has an output gear 42 that drives a drive gear 44 that is fixed to the drive tube 34. Motor 40 is a small D. C. motor with builtin gears for slow speed and high torque. A three way switch 46 on support housing 14, shown in FIG. 1, has an off position and positions to reverse the voltage polarity to motor 40 which in turn causes either clockwise or counterclockwise rotation of drive tube 34.

A tapered varying width drive head 46 for engaging a cartridge drive connection is attached to a flexible rod 48 leading to a generally cylindrical member 50 that has a pair of opposed ridges 52 that slide within grooves in the interior of drive tube 34 forming a splined connection. A spring 54 within drive tube 34 is connected at one end to an end plug 56 and at the other end to a plunger 58 that is spring biased outwardly against member 50 of the drive head apparatus.

Ribbon cartridges typically have a female type of drive connection. These drive connections may vary in size, diameter, and number of grooves. The drive head 46 with its tapered shape may operatively engage many different cartridge drive connections. The depth of a cartridge may be accommodated by drive head 46 sliding in and out against the bias of spring 54, which spring pressure holds drive head 46 in position within the cartridge drive connection to impart rotation to the ribbon to be reinked. Drive head 46 is preferably tapered with a shape like a conventional screw driver. Drive head 46 has a portion that increases in width progressively from the outer end that extends into the cartridge drive connection recess. The height of the drive head 46 may similarly progressively increase in the same area.

A recess 59 in support housing 14 extends around rod 48 to accommodate an external, projecting drive connection that is found on some cartridges.

FIG. 4 illustrates a modification employed with reel to reel type ribbons. A round drive head 60 can be inserted into a reel and held in place by a spring clip 62 by friction fit. Drive head 60 has a member 64 which is inserted into splined connection in drive tube 34. A stop 66 controls the depth of insertion of member 64. The bias of spring 54 is not needed when using this substitute drive head.

An inker 68 is attached near the top of support housing 14. A nonrotating ribbon guide 70 has an extension 72 that fits into a rectangular recess 74 in support housing 14.

Referring to FIG. 5, inker 68 is supported upon extension 72 by four spaced pins 73 inserted into recesses in extension 72. Inker 68 includes an ink supply bottle 75 threaded into place and discharging into a passage 76. The flow of ink in passage 76 is regulated by a control member 78. From passage 76, ink flows to an ink sponge 80 that stores ink and feeds ink by gravity to an ink felt 82 that applies ink to a ribbon passing over ribbon guide 70. Ink is absorbed by the ribbon which then returns to the cartridge.

Referring to FIGS. 7, 8, 9, and 10, there are two rectangular recesses 74 spaced near the upper corners of support housing 14. Inker 68 is selectively positioned in one of recesses 74 depending upon whether the cartridge is right hand or left hand drive.

FIG. 7 shows a small right hand drive cartridge 84 being reinker. In the case, inker 68 is mounted in the recess 74 on the left side of support housing 14.

FIG. 8 shows the invention as applied to reink the ribbon in a small left hand drive cartridge 86, and in this case the inker 68 is mounted on the right side of support housing 14.

FIGS. 9 and 10 show the invention as applied to a large left hand drive cartridge 88 in FIG. 9, and to a large right hand drive cartridge 90 in FIG. 10.

FIG. 11 illustrates reinking of a reel to reel type ribbon. A takeup reel 92 for receiving reinked ribbon leaving inker 68 is mounted on the substitute round drive head 60 of FIG. 4. A supply reel 94 with the ribbon to be reinked is secured in the left side recess 74 employing a reel support shown in FIG. 6. The reel support includes a removable end cap 96 in friction fit on a rod 98 that supports the supply reel 94, which cap 96 is applied after the supply reel 94 is in place. An extension 100 extends into recess 74 and its position can be adjusted in or out to align the supply reel 94 with the inker 68 and take up reel 92.

I claim:

1. Ribbon reinking apparatus comprising a support frame including a horizontal base and a vertical support housing, clamp means for holding a ribbon cartridge adjustably mounted on said base to accept cartridges of different size, said clamp means including a pair of soft, resilient plate members for contacting opposite sides of a cartridge and being deformable to accommodate cartridges of different size add shape,drive means including a tapered drive head to engage a drive connection recess provided in the ribbon cartridge to move a ribbon provided in said cartridge, said drive means being connected to said support housing above said plate members, and inking means mounted on said support housing remote from said cartridge.

2. Apparatus according to claim 1, wherein said drive head includes at an outer end a portion of progressively increasing width for extending into said drive connection recess.

3. Apparatus according to claim 1, wherein said drive head is readily removable, and further comprising a substitute drive head for use in reinking a ribbon of the reel to reel type, said substitute drive head being shaped to engage within a drive connection recess provided in a reel to move a ribbon provided therein.

4. Apparatus according to claim 1, further comprising locking means mounted on said support frame for locking said plate members in desired position.

5. Apparatus according to claim 1, further comprising means to mount said inking means on one side of said drive head when the cartridge is a right hand drive and on the other side of said drive head when the cartridge is a left hand drive.

6. Apparatus according to claim 5, wherein said inking means include an ink felt for contacting a ribbon to be reinked, and means to adjust the flow of ink to said ink felt.

7. Apparatus according to claim 1, first mounting means to mount said inking means on said support housing on one side of said drive head when the cartridge is a right hand drive, second mounting means to mount said inking means on said support housing on the other side of said drive head when the cartridge is a left hand drive, a substitute drive head for use in reinking a ribbon of the reel to reel type, and a supply reel positioned on one of said first and second mounting means when said substitute drive head is in use.

* * * * *